US007994408B1

(12) United States Patent
Mondell

(10) Patent No.: US 7,994,408 B1
(45) Date of Patent: Aug. 9, 2011

(54) SEVEN STRING GUITAR

(76) Inventor: Robert T. Mondell, Forked River, NJ (US)

( * ) Notice: Subject to any disclaimer, the term of this patent is extended or adjusted under 35 U.S.C. 154(b) by 0 days.

(21) Appl. No.: 12/806,857

(22) Filed: Aug. 23, 2010

Related U.S. Application Data

(60) Provisional application No. 61/279,551, filed on Oct. 22, 2009.

(51) Int. Cl.
*G10D 3/00* (2006.01)

(52) U.S. Cl. ..... 84/267

(58) Field of Classification Search ..... 84/237, 84/293, 290, 267
See application file for complete search history.

(56) References Cited

U.S. PATENT DOCUMENTS 5,949,005 A * 9/1999 Peterson ..... 84/291

* cited by examiner

*Primary Examiner* — Kimberly Lockett
(74) *Attorney, Agent, or Firm* — Michael R. Philips

(57) ABSTRACT

A seven string guitar having a neck configured with a first tapered portion and a second tapered portion. The first tapered portion is relatively narrow adjacent to the guitar head and increases in width toward the guitar body. The second tapered portion is relatively narrow adjacent to the first tapered portion and increases in width toward the guitar body. The standard set of six strings are stretched across the neck, and a seventh string is stretched over the first tapered portion and over the open space adjacent to the second tapered portion. A player of the seven string guitar is able to use the thumb to access the seventh string.

9 Claims, 2 Drawing Sheets

SEVEN STRING GUITAR

RELATED APPLICATION

This application is a conversion of provisional patent application No. 61/279,551 filed on Oct. 22, 2009.

FIELD OF THE INVENTION

The present invention relates to the field of guitars, and more particularly to a guitar neck configuration.

BACKGROUND OF THE INVENTION

Traditional guitars have six strings that are stretched along the length of the neck from the guitar body to the guitar head. A new development in guitar design adds a seventh string that vibrates at a lower pitch than the lowest of the six strings. The added seventh string allows a player to achieve a broader range of notes and chords than previously possible with a six string guitar.

The necks of previously known guitars are configured with a taper that transitions from a relatively narrow dimension at the distal end adjacent to the head to a wider dimension at the end adjacent to the guitar body. The tapered shape of the neck provides a structurally strong neck that is narrow enough to be comfortably spanned by the hand of the player when used with the traditional six strings. Guitar strings are depressed with the player's fingers between frets in varying patterns to play notes and chords. However, the addition of a seventh string requires the guitar neck to be wider throughout the length than in a six string guitar. This makes the reach to span the seventh string in the wider portion of the neck either impossible or uncomfortable for most players.

SUMMARY OF THE INVENTION

The present invention provides a seven string guitar having a neck that is configured to overcome the difficulty of reach required by the prior known tapered neck. The neck of the seven string guitar invention described herein is formed with a first tapered portion and a second tapered portion that are separated by a step. The step between the first tapered portion and the second tapered portion is at the approximate center of the neck length. The thickness of the neck in the second tapered portion permits the seventh string to reside beside the neck thickness, keeping the neck thickness comfortable for the player and allowing the player to access the seventh string using the player's thumb.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
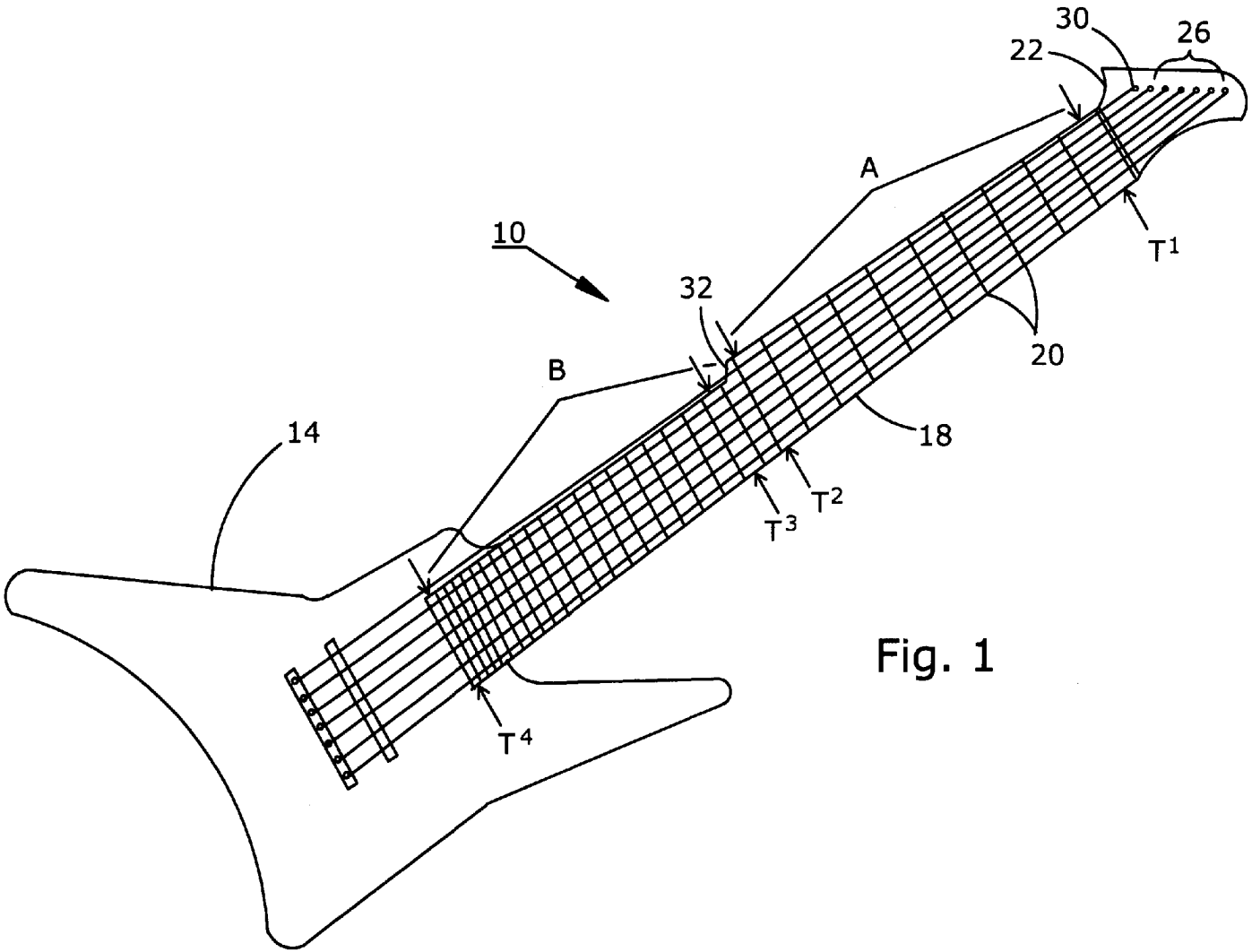
FIG. 1 is a front elevation view of the seven string guitar of the present invention.

Referring to FIG. 1, guitar 10 is depicted in front elevation view. A neck 18 is fixedly connected at a proximal end thereof to a body 14 and a head 22 is mounted to the distal end of neck 18. The illustrated configuration and shape of guitar 10 is an example without limiting the scope of the invention disclosed. A set of six traditional strings 26 and a seventh string 30 are held in tension between body 14 and head 22. The strings are installed to be substantially parallel to one another. A plurality of frets 20 are mounted at selected intervals in transverse orientation along neck 18 as an aid to the guitar player in note definition.

Referring further to FIG. 1, neck 18 is divided into a first tapered portion A and a second tapered portion B. Portion A and portion B are approximately equal in length in the example shown, i.e. portion A and portion B of neck 18 are each approximately one half the length of neck 18. A step 32 provides a transition between first tapered portion A and second tapered portion B. As shown, both first tapered portion A and second tapered portion B are tapered from each respective distal end having a relatively narrow width, noted as $T^1$, and $T^3$, to each respective proximal end having a relatively broad width, noted as $T^2$ and $T^4$, the widths measured in a direction parallel to frets 20 across the face of neck 18. According to the preferred embodiment of the invention, widths $T^1$ and $T^3$ are each approximately 50 mm (2.0 inches) wide and widths $T^2$ and $T^4$ are each approximately 59 mm (2.3 inches) wide.

Continuing with FIG. 1, as illustrated seventh string 30 is positioned over the edge section of first tapered portion A. At intermediate step 32, seventh string 30 continues to follow a straight line from head 22 to body 14, becoming suspended adjacent to, rather than over, second tapered portion B. Each of six strings 26 and seventh string 30 are tuned in the conventional manner by turning a set of rotatable pins mounted in head 22.

Figure 2:
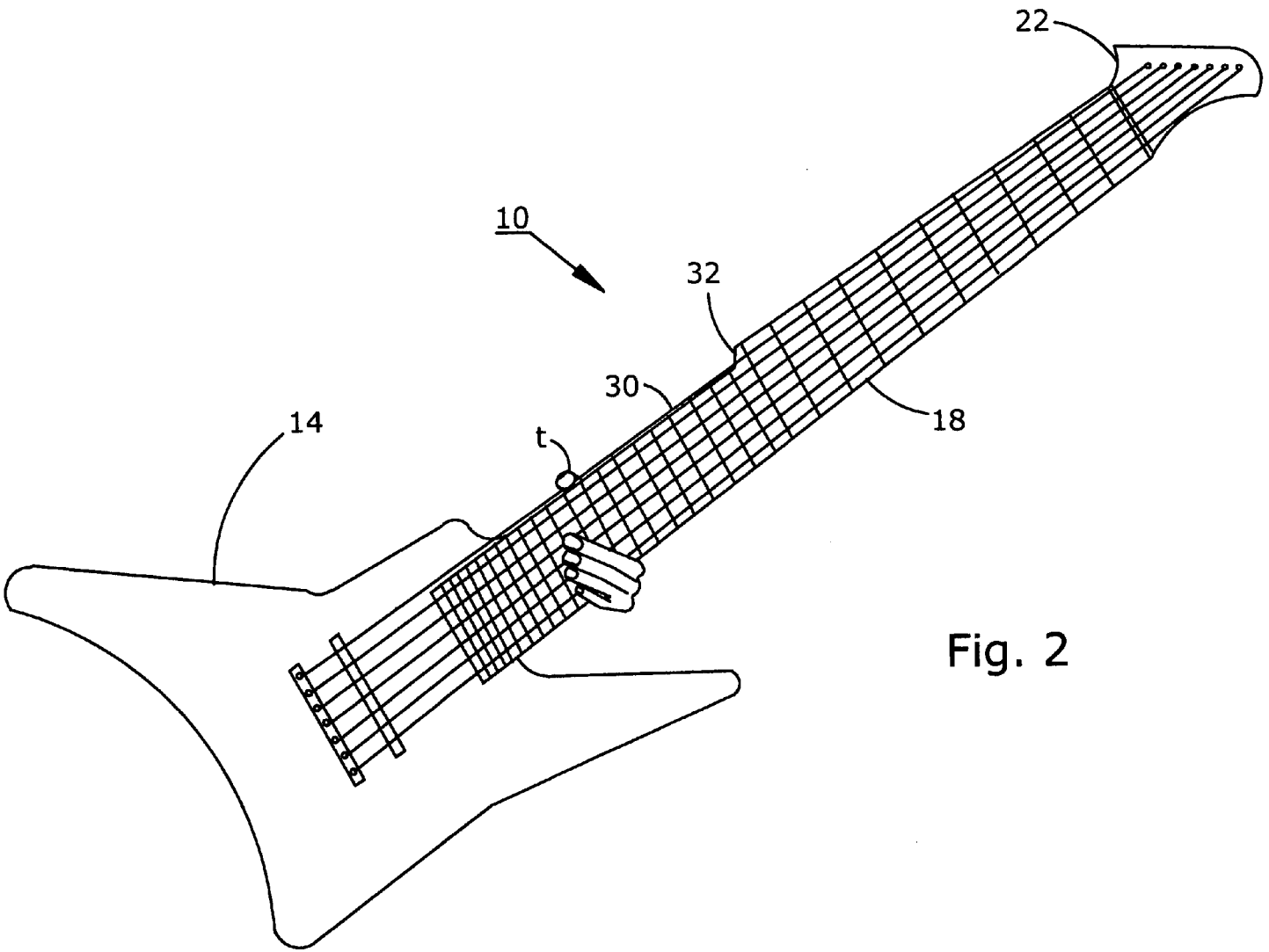
FIG. 2 is the front elevation view of the guitar of FIG. 1 with the hand of a player positioned for playing a chord utilizing the seventh string.

Referring now to FIG. 2, guitar 10 of the present invention is illustrated as it is being played. FIGS. 1 and 2 show guitar 10 in the typical configuration with the player's left hand fingering chords and the player's right hand (not shown) strumming or picking the strings adjacent to body 14. The string toward the bottom of guitar 10 has the highest pitch and seventh string 30 toward the top of guitar 10 has the lowest pitch. It is to be understood that the principles of the invention apply equally to a guitar intended for use with the right hand fingering chords and the left hand strumming or picking. The dual tapered edge of neck 18 is therefore formed on the opposite side that becomes the upper side when played with opposite hand positions. The strings are also installed in opposite sequence. The principles of the present invention are similarly applicable to acoustic or electric guitars.

Continuing with FIG. 2, the hand of a player is positioned for fingering a chord in the second tapered portion of neck 18. Seventh string 30 is seen as being suspended in the gap between step 32 and guitar body 14 adjacent to the edge of neck 18. Therefore the thumb t of the player presses seventh string 30 against the upper edge of neck 18. Since seventh string 30 has the lowest pitch, the ability to play seventh string 30 to the full length thereof maximizes the range of notes and chords available.

While the description above discloses preferred embodiments of the present invention, it is contemplated that numerous variations and modifications of the invention are possible and are considered to be within the scope of the claims that follow.

What is claimed is:

1. A seven string guitar having a body, a neck and a head, the neck comprising:

a. a first tapered portion connected to the head;

b. a second tapered portion connected at a first end to the first tapered portion and at a second end to the body;

c. the first tapered portion being relatively narrow adjacent to the head and relatively wide adjacent to the second tapered portion;

d. the second tapered portion being relatively narrow adjacent to the first tapered portion and relatively wide adjacent to the body; and e. a step formed to transition from the first tapered portion to the second tapered portion;

f. the width of the first tapered portion and the width of the second tapered portion being measured in a direction substantially parallel to a series of frets formed across the face of the neck.

2. The seven string guitar described in claim 1, further comprising a plurality of strings extending across the neck from the head to the body, wherein one of the plurality of strings passes over the first tapered portion and passes adjacent to the second tapered portion.

3. The seven string guitar described in claim 1, wherein the first tapered portion and the second tapered portion are substantially equal in length.

4. The seven string guitar described in claim 1, wherein the relatively narrow end of the first and second tapered portions are substantially equal in width and the relatively wide end of the first and second tapered portions are substantially equal in width.

5. The seven string guitar described in claim 4, wherein the relatively narrow end of the first and second tapered portions are approximately 50 mm (2.0 inches) in width and the relatively wide end of the first and second tapered portions are approximately 59 mm (2.3 inches) in width.

6. A seven string guitar having a body, a neck and a head, the neck comprising:

a. a first tapered portion connected to the head;

b. a second tapered portion connected at a first end to the first tapered portion and at a second end to the body;

c. the first tapered portion being relatively narrow adjacent to the head and relatively wide adjacent to the second tapered portion;

d. the second tapered portion being relatively narrow adjacent to the first tapered portion and relatively wide adjacent to the body; and e. a step formed to transition from the first tapered portion to the second tapered portion;

f. wherein the first tapered portion and the second tapered portion are substantially equal in length.

7. The seven string guitar described in claim 6, wherein the relatively narrow end of the first and second tapered portions are substantially equal and the relatively wide end of the first and second tapered portions are substantially equal.

8. The seven string guitar described in claim 7, wherein the relatively narrow end of the first and second tapered portions are approximately 50 mm (2.0 inches) in width and the relatively wide end of the first and second tapered portions are approximately 59 mm (2.3 inches) in width.

9. The seven string guitar described in claim 6, further comprising a plurality of strings extending from the head to the body, one of the plurality of strings passing over the first tapered portion and suspended adjacent to the second tapered portion.

* * * * *